US008379799B2

(12) United States Patent
Parker et al.

(10) Patent No.: US 8,379,799 B2
(45) Date of Patent: Feb. 19, 2013

(54) ELECTRICALLY INSULATING X-RAY SHIELDING DEVICES IN AN X-RAY TUBE

(75) Inventors: Todd S. Parker, Kaysville, UT (US); James E. Burke, Glenview, IL (US)

(73) Assignee: Varian Medical Systems, Inc., Palo Alto, CA (US)

( * ) Notice: Subject to any disclaimer, the term of this patent is extended or adjusted under 35 U.S.C. 154(b) by 294 days.

(21) Appl. No.: 12/913,432

(22) Filed: Oct. 27, 2010

(65) Prior Publication Data

US 2012/0106713 A1 May 3, 2012

(51) Int. Cl.
*H01J 35/10* (2006.01)

(52) U.S. Cl. ..... 378/142; 378/121

(58) Field of Classification Search ..... 378/121, 378/140, 142, 204
See application file for complete search history.

(56) References Cited

PUBLICATIONS

Parker, Todd S., U.S. Appl. No. 12/817,373, filed Jun. 17, 2010, "X-Ray Tube Rotating Anode."

*Primary Examiner* — Courtney Thomas
(74) *Attorney, Agent, or Firm* — Maschoff Gilmore & Israelsen

(57) ABSTRACT

Electrically insulating x-ray shielding devices in an x-ray tube. In one example embodiment, an x-ray tube includes an evacuated enclosure, a cathode and an anode at least partially positioned within the evacuated enclosure, and an electrically insulating x-ray shielding device proximate to the evacuated enclosure. The electrically insulating x-ray shielding device includes an oxide or nitride material having an atomic number from 57 to 74.

20 Claims, 7 Drawing Sheets

ELECTRICALLY INSULATING X-RAY SHIELDING DEVICES IN AN X-RAY TUBE

BACKGROUND

X-ray tubes are extremely valuable tools that are used in a wide variety of applications, both industrial and medical. An x-ray tube typically includes a cathode and an anode positioned within an evacuated enclosure. The cathode includes an electron source and the anode includes a target surface that is oriented to receive electrons emitted by the electron source. During operation of the x-ray tube, an electric current is applied to the electron source, which causes electrons to be produced by thermionic emission. The electrons are then accelerated toward the target surface of the anode assembly by applying a high-voltage potential between the cathode assembly and the anode assembly. When the electrons strike the anode assembly target surface, the kinetic energy of the electrons causes the production of x-rays. The x-rays are produced in an omnidirectional fashion where the useful portion ultimately exits the x-ray tube through a window in the x-ray tube, and interacts with a material sample, patient, or other object with the remainder being absorbed by other structures including those whose specific purpose is absorption of x-rays with non-useful trajectories or energies.

The target surface of the x-ray tube anode is generally angled, or otherwise oriented, so as to maximize the amount of x-rays produced at the target surface that can exit the x-ray tube via the window. Notwithstanding the orientation of the anode target surface, some errant x-rays nonetheless emanate in various directions from the target surface. Further, some electrons back scatter off of the target surface and strike other surfaces within the x-ray tube, which sometimes results in the production of additional errant x-rays. Thus, while some x-rays do exit through the window and are utilized as intended, other errant x-rays do not exit through the window. Errant x-rays that do not pass through the window often penetrate instead into other areas of the x-ray tube, where the errant x-rays may, undesirably, be transmitted through other x-ray tube surfaces if sufficient measures to prevent the escape of errant x-rays are not taken.

The escape of errant x-rays from an x-ray tube is undesired as such x-rays can represent a significant source of x-ray exposure to x-ray tube surroundings. For instance, errant x-rays can result in transmission of a relatively high level of radiation to an x-ray tube operator. In addition, errant x-rays can interfere with the imaging x-ray stream that is transmitted through the window. Such interference may compromise the quality of the images obtained with the x-ray device. For example, errant x-rays can impinge upon areas of the x-ray subject and interfere with the image being sought. The resulting interference may be manifested as clouding in the image.

While the problem of errant x-rays can be realized throughout the tube environment, certain areas of the x-ray tube are especially susceptible to the impingement of errant x-rays. For example, various devices in an x-ray tube are formed from electrically insulating materials, such as silicon glasses or alumina ceramics, that are not effective at shielding x-rays. Such electrically insulating devices may be employed, for example, in connection with a high-voltage cable that supplies high-voltage electrical power to the x-ray tube. As errant x-rays emanate directly or indirectly from the target surface toward an electrically insulating device, x-rays typically pass through the electrically insulating device without being absorbed, thus necessitating supplemental shielding around the electrically insulating device, either inside the x-ray tube or external to the x-ray tube.

The addition of supplemental shielding to an x-ray tube can be problematic however. For example, while supplemental shielding can be effective at absorbing x-rays, the supplemental shielding, which is often made of lead for example, can be relatively heavy and substantially adds to the weight of the x-ray tube. This factor becomes important in applications where a relatively low x-ray tube weight is desired or even required. Further, the addition of supplemental shielding can represent a significant cost in time and labor during x-ray tube manufacture.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF SOME EXAMPLE EMBODIMENTS

In general, example embodiments relate to electrically insulating x-ray shielding devices in an x-ray tube. Among other things, example embodiments of the electrically insulating x-ray shielding devices disclosed herein are configured to reduce, if not eliminate, the need for supplemental x-ray shielding in areas of an x-ray tube that require or benefit from electrical insulation. Reducing or eliminating the need for supplemental x-ray shielding reduces the cost and weight of the x-ray tube.

In one example embodiment, a high-voltage gasket for an x-ray tube includes an electrically insulating base material with electrically insulating x-ray shielding oxide or nitride particles dispersed therein. The dispersed electrically insulating x-ray shielding oxide or nitride particles have an atomic number from 57 to 74.

In another example embodiment, a high-voltage connector for an x-ray tube includes a shell configured to be removably attached to an evacuated enclosure of an x-ray tube, an opening defined in the shell configured to receive a high-voltage electrical cable, and a potting material positioned within the shell. The potting material comprising an electrically insulating base material with electrically insulating x-ray shielding oxide or nitride particles dispersed therein.

In yet another example embodiment, an x-ray tube includes an evacuated enclosure, an anode at least partially positioned within the evacuated enclosure, and a cathode at least partially positioned within the evacuated enclosure. The evacuated enclosure includes a ceramic portion formed from an electrically insulating x-ray shielding oxide or nitride ceramic having an atomic number from 57 to 74. The cathode is electrically coupled to electrical connections that run through the ceramic portion of the x-ray tube.

In still another example embodiment, an x-ray tube includes an evacuated enclosure, a cathode and an anode at least partially positioned within the evacuated enclosure, and an electrically insulating x-ray shielding device proximate to the evacuated enclosure. The electrically insulating x-ray shielding device includes an oxide or nitride material having an atomic number from 57 to 74.

These and other aspects of example embodiments of the invention will become more fully apparent from the following description and appended claims.

BRIEF DESCRIPTION OF THE DRAWINGS

To further clarify certain aspects of the present invention, a more particular description of the invention will be rendered by reference to example embodiments thereof which are disclosed in the appended drawings. It is appreciated that these drawings depict only example embodiments of the invention and are therefore not to be considered limiting of its scope. Aspects of example embodiments of the invention will be described and explained with additional specificity and detail through the use of the accompanying drawings in which.

DETAILED DESCRIPTION OF SOME EXAMPLE EMBODIMENTS

Example embodiments of the present invention relate to electrically insulating x-ray shielding devices in an x-ray tube. Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

1. Example X-Ray Tube

Figure 1A:
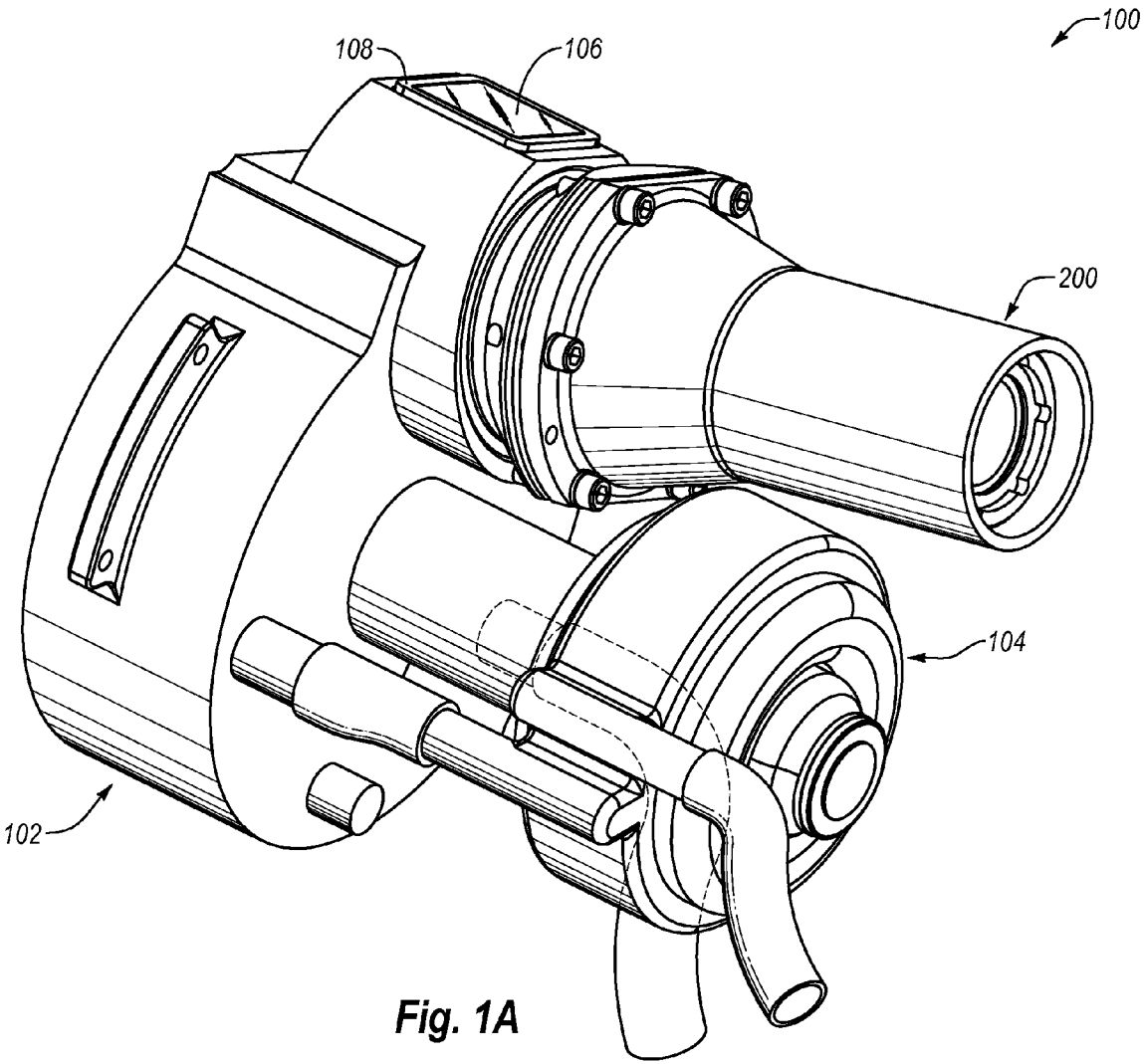
FIG. 1A is a perspective view of an example x-ray tube.
Figure 1B:
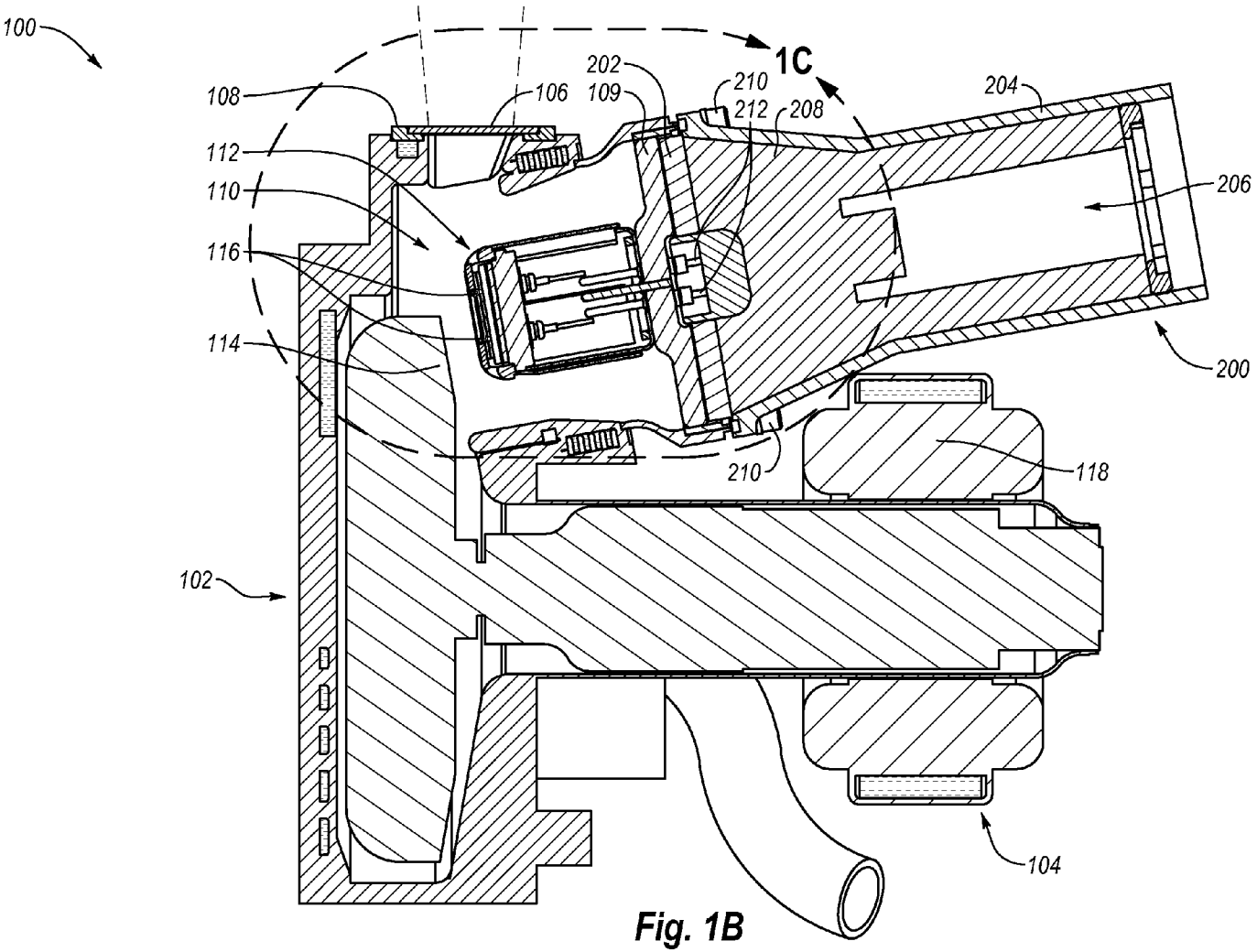
FIG. 1B is a side cross-sectional side view of the example x-ray tube of FIG. 1A.
Figure 1C:
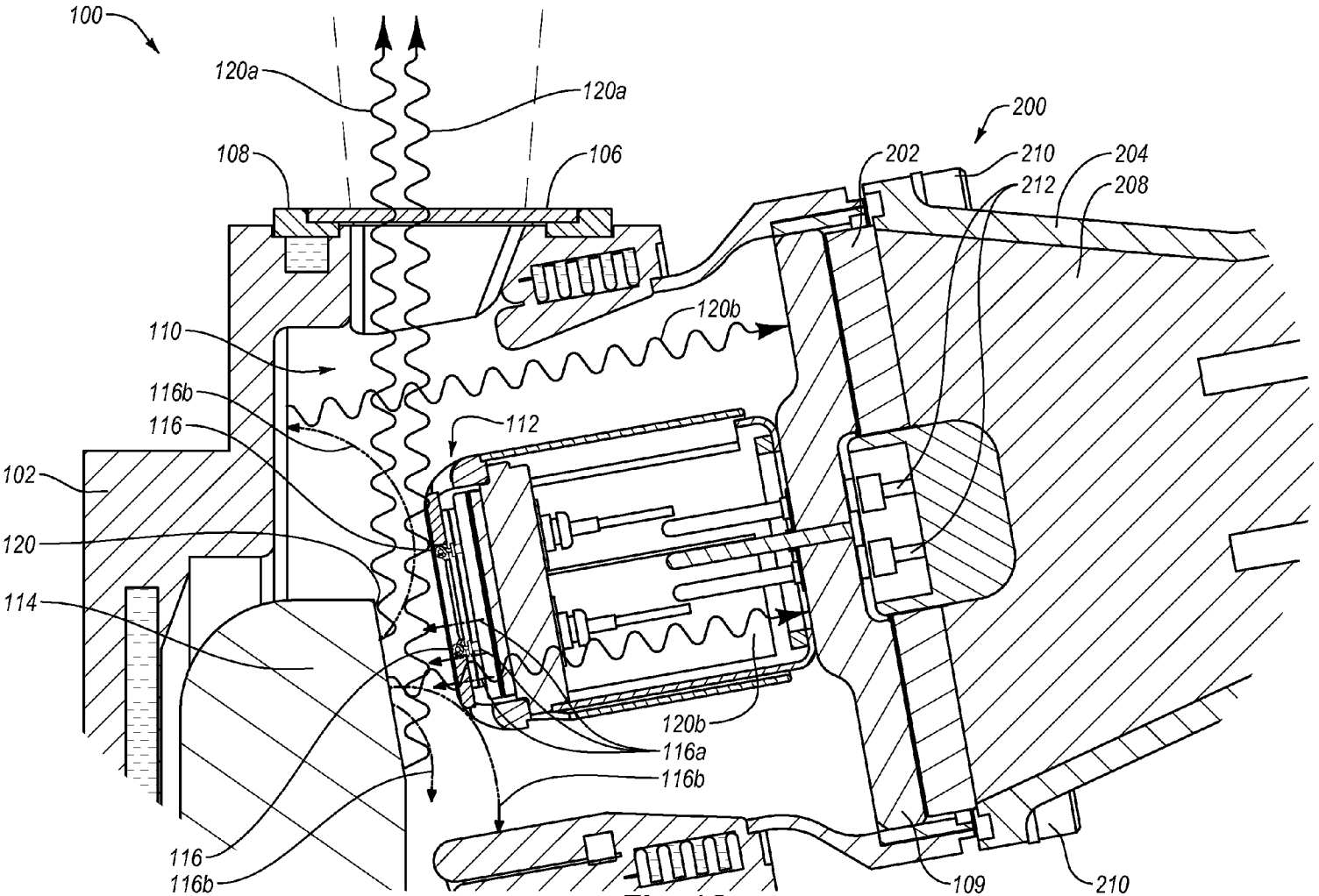
FIG. 1C is an enlarged cross-sectional side view of the example x-ray tube of FIG. 1B.

With reference first to FIGS. 1A-1C, an example x-ray tube 100 is disclosed. The example x-ray tube 100 is configured for use in mammography applications, but it is understood that the electrically insulating x-ray shielding devices disclosed herein can be employed in x-ray tubes configured for use in other applications including, but not limited to, computed tomography (CT), diagnostic, or industrial.

As disclosed in FIG. 1A, the example x-ray tube 100 generally includes a can 102, a high-voltage connector 200 attached to the can 102, a stator housing 104 attached to the can 102, and an x-ray tube window 106 attached to a window frame 108 of the can 102. The x-ray tube window 106 is comprised of an x-ray transmissive material, such as beryllium or other suitable material(s). The can 102 and the stator housing 104 may each be formed from stainless steel, such as 304 stainless steel.

As disclosed in FIG. 1B, the x-ray tube window 106, the can 102, and a ceramic portion 109 at least partially define an evacuated enclosure 110 within which a cathode 112 and a rotating anode 114 are positioned. More particularly, the cathode 112 extends from the ceramic portion 109 into the can 102 and the anode 114 is at least partially positioned within the can 102. The anode 114 is spaced apart from and oppositely disposed to the cathode 112, and may be at least partially composed of a thermally conductive material such as copper or a molybdenum alloy for example. The anode 114 and cathode 112 are connected in an electrical circuit that allows for the application of a high voltage potential between the anode 114 and the cathode 112. The cathode 112 includes emitters 116 that are connected to an appropriate power source (not shown). The anode 114 is rotated by a stator 118 that is positioned within the stator housing 104.

As disclosed in FIG. 1C, prior to operation of the example x-ray tube 100, the evacuated enclosure 110 is evacuated to create a vacuum. Then, during operation of the example x-ray tube 100, an electrical current is passed through the emitters 116 of the cathode 112 to cause electrons 116*a*, to be emitted from the cathode 112 by thermionic emission. The application of a high voltage differential between the anode 114 and the cathode 112 then causes the electrons 116*a* to accelerate from the emitters 116 and toward a rotating focal track 120 that is positioned on the rotating anode 114. The focal track 120 may be composed for example of tungsten or other material(s) having a high atomic ("high Z") number. As the electrons 116*a* accelerate, they gain a substantial amount of kinetic energy, and upon striking the target material on the rotating focal track 120, some of this kinetic energy is converted into x-rays 120*a*.

The focal track 120 is oriented so that many of the emitted x-rays 120*a* are directed toward the x-ray tube window 106. As the x-ray tube window 106 is comprised of an x-ray transmissive material, the x-rays 120*a* emitted from the focal track 120 pass through the x-ray tube window 106 in order to strike an intended target (not shown) to produce an x-ray image (not shown). The window 106 therefore seals the vacuum of the evacuated enclosure of the x-ray tube 100 from the atmospheric air pressure outside the x-ray tube 100 and yet enables the x-rays 120*a* generated by the rotating anode 114 to exit the x-ray tube 100.

The orientation of the focal track 120 also results in errant x-rays 120*b* being emitted from the focal track 120 toward various interior surfaces of the can 102 and the high-voltage connector 200. Further, the orientation of the focal track 120 also results in some of the electrons 116*a* being deflected off of the focal track 120 toward various interior surfaces of the can 102, the high-voltage connector 200, and the window 106. These deflected electrons are referred to as "backscatter electrons" 116*b* herein. The backscatter electrons 116*b* have a substantial amount of kinetic energy. When the backscatter electrons 116*b* strike some surfaces of the can 102, some of this kinetic energy is converted into errant x-rays 120*b*. The high-voltage connector 200 includes, or is associated with, one or more electrically insulating x-ray shielding devices, as discussed below, to reduce or prevent these errant x-rays 120*b* from escaping from the x-ray tube 100 through the high-voltage connector 200.

Although the example x-ray tube 100 is depicted as a rotating anode x-ray tube, example embodiments disclosed herein may be employed in other types of x-ray tubes. Thus, the example electrically insulating x-ray shielding devices disclosed herein may alternatively be employed, for example, in a stationary anode x-ray tube.

2. Example High-Voltage Connector

Figure 2:
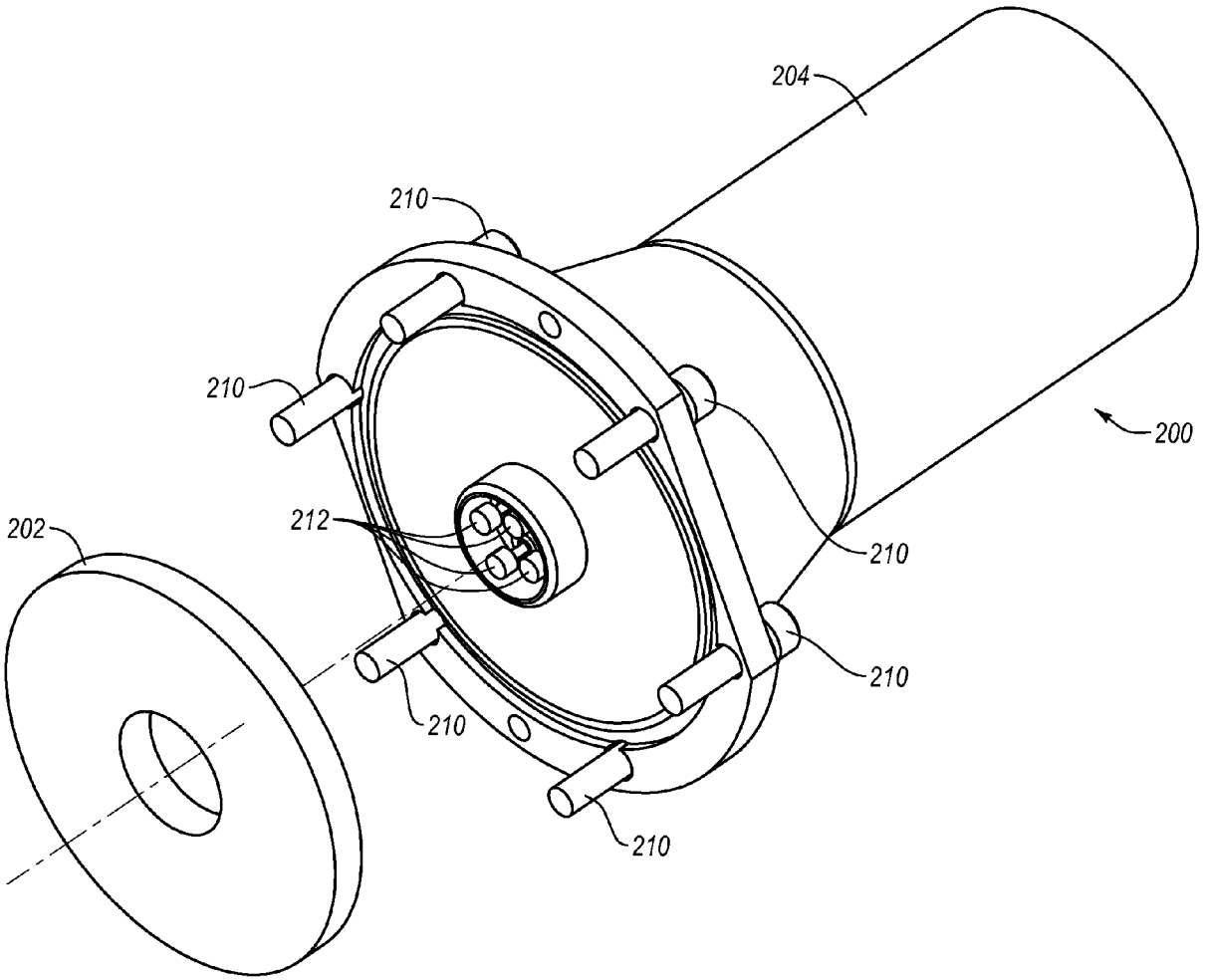
FIG. 2 is an exploded perspective view of the example high-voltage connector and gasket of the example x-ray tube of FIGS. 1A-1C.

With reference now to FIGS. 1B, 1C, and 2, additional aspects of the example high-voltage connector 200, ceramic portion 109, and cathode 112 are disclosed. Further, aspects of an example high-voltage gasket 202 are disclosed. As disclosed in FIGS. 1B and 1C, the example high-voltage connector 200 includes a shell 204, a receptacle 206 defined in the shell 204, and a potting material 208 positioned within the shell 204. The receptacle 206 is configured to receive a high-voltage electrical cable (not shown) in order to receive high-voltage electrical power into the high-voltage connector 200. The shell 204 is removably attached to the evacuated enclosure 110 of the x-ray tube 100 using the fasteners 210 in order to enable electrical coupling of the high-voltage electrical cable (not shown) to the emitters 116 of the cathode 112.

The removability of the high-voltage connector 200 enables the high-voltage connector 200 and/or the high-voltage gasket 202 to be removed and/or replaced during servicing of the x-ray tube 100. The potting material 208 insulates the electrical connections running through the high-voltage connector 200.

As disclosed in FIGS. 1B and 1C, the high-voltage gasket 202 seals the high-voltage connector 200 to the ceramic portion 109 of the evacuated enclosure 110. As disclosed in FIGS. 1B, 1C, and 2, and the high-voltage gasket 202 also surrounds electrical connections 212 running between the high-voltage connector 200 and the cathode 112. The gasket 202 is configured to withstand and insulate the high-voltage electrical power communicated through the high-voltage connector 200. The gasket 202 also functions to continue the dielectric path and exclude air between the high-voltage potentials of the electrical connections 212 and the grounded potential shell 204.

As disclosed in FIGS. 1B and 1C, and as noted above, the ceramic portion 109 partially defines the evacuated enclosure 110. The ceramic portion 109 is configured to hermetically seal the evacuated interior of the evacuated enclosure 110 from the atmospheric air pressure outside the x-ray tube 100. The ceramic portion 109 also provides structural support to surrounding structures of the evacuated enclosure 110.

In at least some example embodiments, the ceramic portion 109 is formed from an electrically insulating x-ray shielding material. Examples of electrically insulating x-ray shielding materials include oxide or nitride materials having an atomic number from 57 to 74, or some combination of two or more such materials. Example oxide or nitride materials having an atomic number from 57 to 74 include cerium, erbium, and ytterbium. The oxide or nitride configuration enables the material to be electrically insulating and the atomic number from 57 to 74 enables the material to be x-ray shielding.

It is understood, however, that non-oxide and non-nitride alternate chemical structures can be employed in place of the oxide and nitride chemical structures disclosed herein. These alternate chemical structures may include chemical bonds which result in materials which are solids, have electrically insulating properties, and have a significant fraction of the chemical structure composed of materials having an atomic number from 57 to 74 in order to be x-ray shielding. The electrically insulating x-ray shielding materials disclosed herein are therefore not limited to oxide or nitride materials.

In at least some example embodiments, the gasket 202 and/or the potting material 208 can also, or alternatively, be formed from an electrically insulating base material with electrically insulating x-ray shielding particles dispersed therein. The electrically insulating base material can be a silicone-based rubber, an epoxy, or a plastic, or some combination thereof, for example. The electrically insulating x-ray shielding particles can be formed from any of the electrically insulating x-ray shielding materials disclosed herein. It is noted that the base material can further include electrically insulating non-x-ray shielding particles dispersed therein, such as silicon glass particles or alumina ceramic particles.

When at least partially formed from electrically insulating x-ray shielding materials, the ceramic portion 109, the gasket 202, and the potting material 208 are examples of electrically insulating x-ray shielding devices. The x-ray shielding properties of the ceramic portion 109, the gasket 202, and the potting material 208 function to shield the region of the x-ray tube 100 proximate the high-voltage connector 200 from errant x-rays 120*b* as disclosed in FIG. 1C.

In at least some example embodiments, the potting material 208 has a first dielectric constant, the ceramic portion 109 has a second dielectric constant, and the gasket 202 has a third dielectric constant. Where the example gasket 202 is formed from an electrically insulating base material with electrically insulating x-ray shielding particles dispersed therein, the dielectric constant of the gasket 202 may be adjusted, for example, by adjusting the ratio of the volume of the electrically insulating x-ray shielding particles, and/or electrically insulating non-x-ray shielding particles, to the volume of the electrically insulating base material. For example, the volume of the electrically insulating x-ray shielding particles may be between about 31% and about 50%. It is understood, however, that other volumes of the electrically insulating x-ray shielding particles are also possible. In addition to total volumetric control of the electrically insulating x-ray shielding particles, the ratio of the various types of electrically insulating x-ray shielding particles can also be adjusted in order to achieve desired electrically insulating and x-ray shielding properties. The dielectric constants of the ceramic portion 109 and/or the potting material 208 may be similarly adjusted.

The third dielectric constant may be configured to transition between the first and second dielectric constants in order to reduce electrostatic stresses, provide high-voltage transient dissipation, and provide charging control between the potting material 208 and the ceramic portion 109. For example, the third dielectric constant may be between the first and second dielectric constants, such as where the third dielectric constant is about an average of the first and second dielectric constants. For example, where the first dielectric constant is about 3, and the second dielectric constant is about 7, the third dielectric constant can be about 5. Alternatively, the third dielectric constant may be less than or greater than the first and second dielectric constants, depending on the geometries of the gasket 202, the potting material 208, and the ceramic portion 109.

Thus, the electrically insulating x-ray shielding ceramic portion 109, gasket 202, and potting material 208 insulates the electrical connections running between the high-voltage cable (not shown) and the emitters 116 of the cathode 112. In addition, the electrically insulating x-ray shielding ceramic portion 109, gasket 202, and potting material 208 reduce, if not eliminate, the need for supplemental x-ray shielding in the region of the x-ray tube 100 proximate the high-voltage connector 200. By reducing or eliminating the need for supplemental x-ray shielding, the electrically insulating x-ray shielding ceramic portion 109, gasket 202, and potting material 208 reduce the cost and weight of the x-ray tube 100.

Although each of the ceramic portion 109, the gasket 202, and potting material 208 are disclosed as being at least partially formed from an electrically insulating x-ray shielding material, it is understood that only one or two of these components may be at least partially formed from an electrically insulating x-ray shielding material, depending on the shielding requirements of the x-ray tube 100.

3. Alternative High-Voltage Connector

Figure 3A:
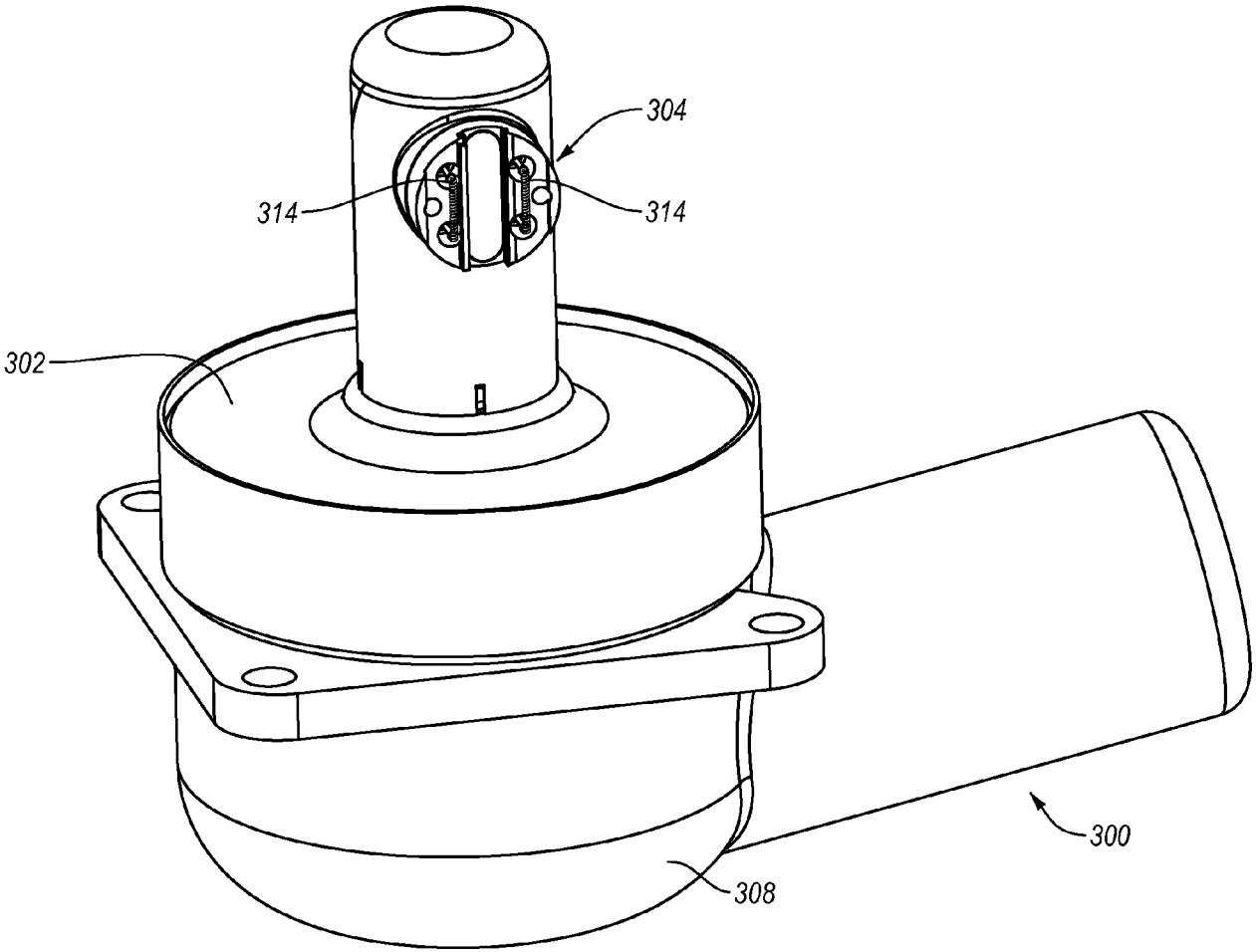
FIG. 3A is a perspective view of an alternative high-voltage connector, ceramic, and cathode assembly of an alternative x-ray tube.
Figure 3B:
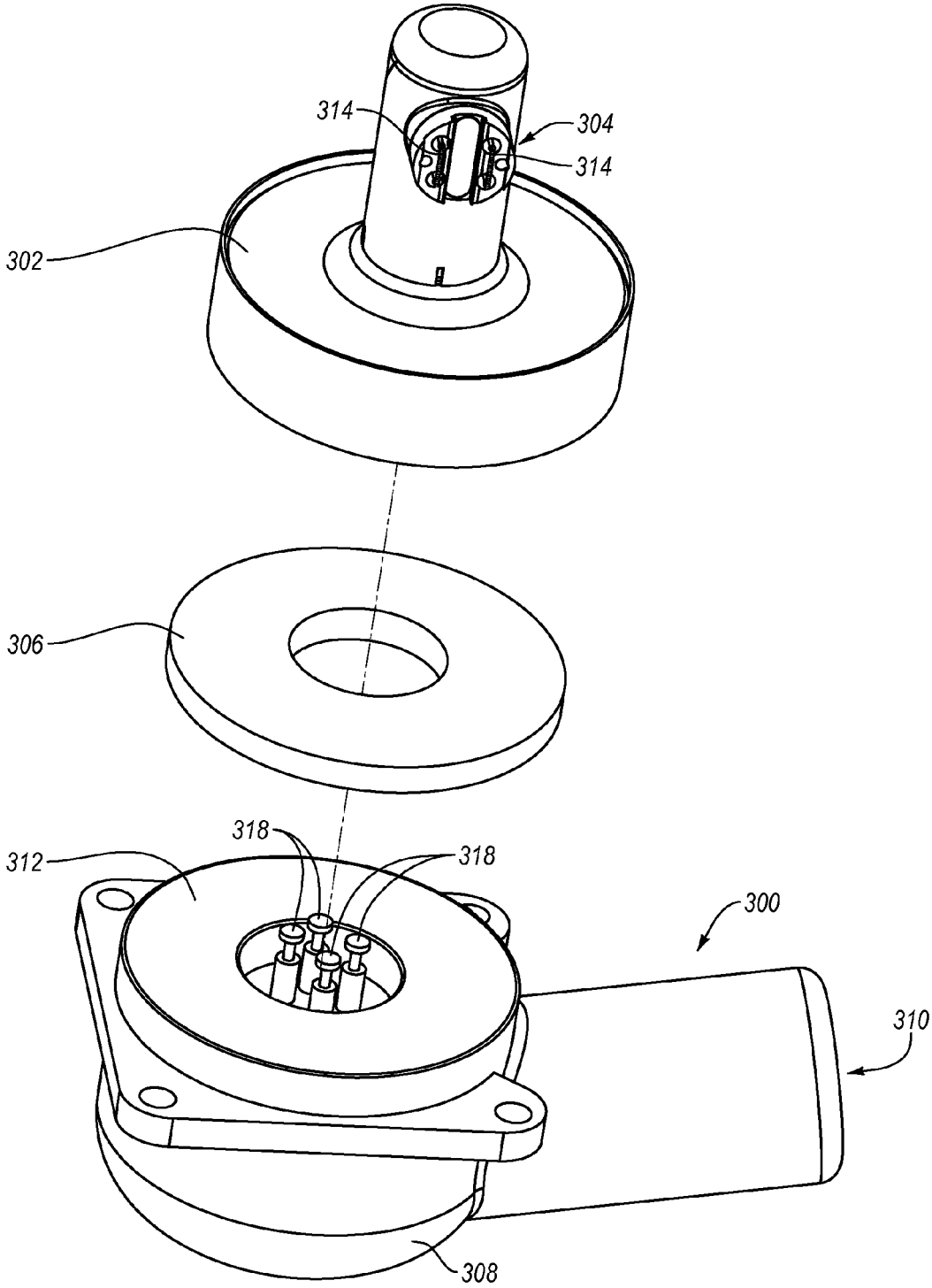
FIG. 3B is a first exploded perspective view of the alternative high-voltage connector, gasket, ceramic, and cathode assembly of FIG. 3A.
Figure 3C:
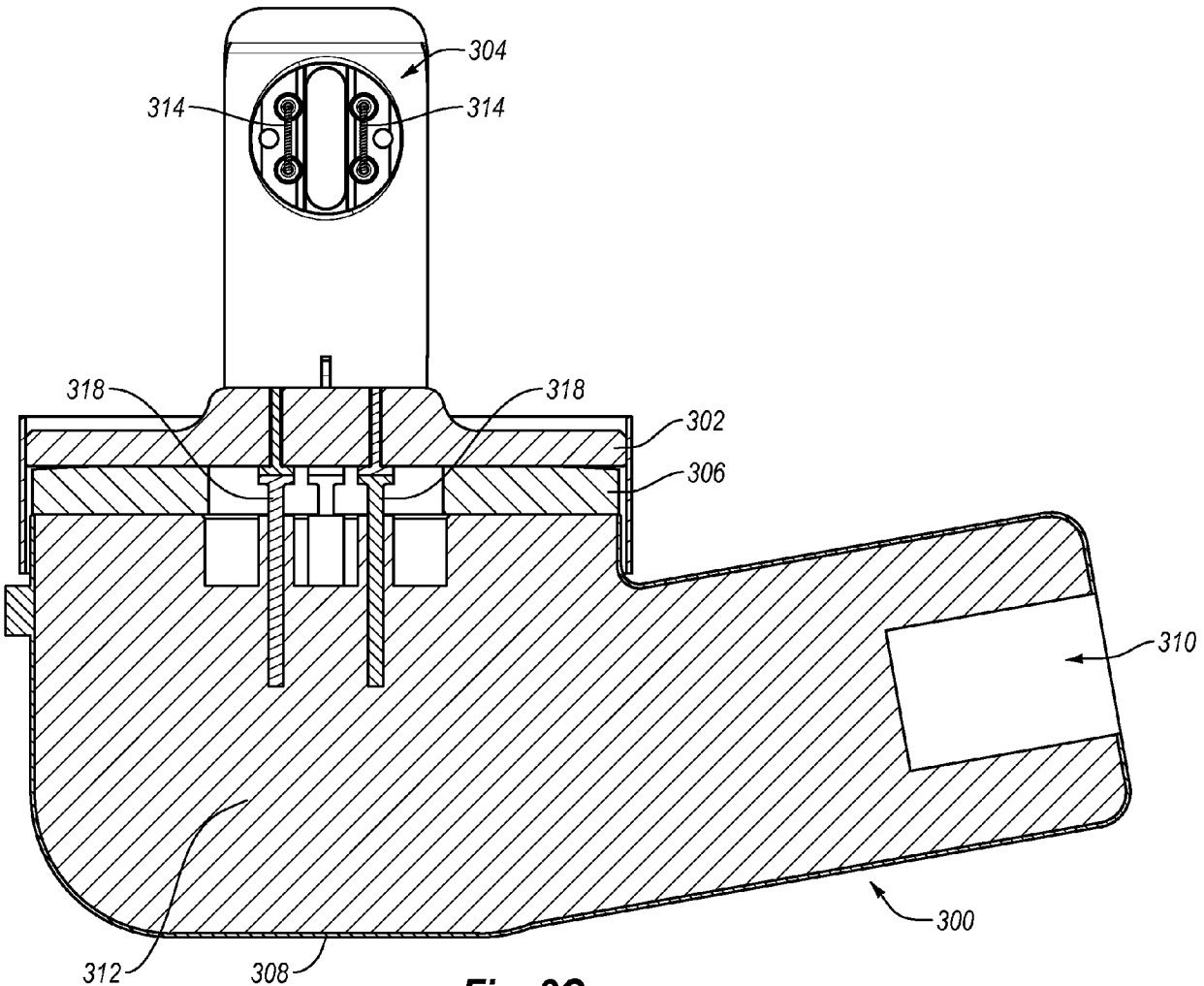
FIG. 3C is partial cross-sectional view of the alternative high-voltage connector, gasket, ceramic, and cathode assembly of FIG. 3A.

With reference now to FIGS. 3A-3C, aspects of an alternative high-voltage connector 300, a ceramic portion 302, a cathode 304, and a high-voltage gasket 306 are disclosed. As disclosed in FIGS. 3A-3C, the high-voltage connector 300 includes a shell 308 and an electrically insulating potting material 312 positioned within the shell 308. The opening designated as 310 in the shell 308 is configured to receive and permanently enclose the termination of a high-voltage electrical cable (not shown) in order to provide high-voltage electrical power to the high-voltage connector 300. The shell 308 is configured to be removably attached to the evacuated enclosure (not shown) of an x-ray tube (not shown) in order to transmit the high-voltage electrical power from the high-voltage electrical cable (not shown) to the emitters 314 of the cathode 304. The potting material 312 insulates the electrical connections 318 running through the high-voltage connector 300.

As disclosed in FIGS. 3B and 3C, the high-voltage gasket 306 seals the high-voltage connector 300 to the ceramic portion 302 of an evacuated enclosure (not shown) of an x-ray tube (not shown). The high-voltage gasket 306 also surrounds the electrical connections 318 running between the high-voltage connector 300 and the cathode 304. The gasket 306 is configured to withstand and insulate the high-voltage electrical power communicated through the high-voltage connector 300. The gasket 306 also functions to continue the dielectric path and exclude air between the high-voltage potentials of the electrical connections 318 and the grounded potential shell 308.

In at least some example embodiments, the ceramic portion 302 is formed from an electrically insulating x-ray shielding material. In at least some example embodiments, the gasket 306 and/or the potting material 312 can also or alternatively be formed from an electrically insulating base material with electrically insulating x-ray shielding particles dispersed therein.

It is further understood that the dielectric constants of the ceramic portion 302, the gasket 306, and the potting material 312 may be configured and adjusted as disclosed herein in order to achieve desired electrically insulating and x-ray shielding properties.

When at least partially formed from electrically insulating x-ray shielding materials, the ceramic portion 302, the gasket 306, and the potting material 312 are examples of electrically insulating x-ray shielding devices. The ceramic portion 302, the gasket 306, and the potting material 312 insulate the electrical connections running between the high-voltage cable (not shown) and the emitters 314 of the cathode 304. In addition, the ceramic portion 302, the gasket 306, and the potting material 312 reduce, if not eliminate, the need for supplemental x-ray shielding proximate the high-voltage connector 300 from errant x-rays of any x-ray tube into which the example high-voltage connector 300 is integrated. By reducing or eliminating the need for supplemental x-ray shielding, the electrically insulating x-ray shielding ceramic portion 302, gasket 306, and potting material 312 reduce the cost and weight of any x-ray tube into which the example high-voltage connector 300 is integrated.

Although each of the ceramic portion 302, the gasket 306, and the potting material 312 is disclosed as being at least partially formed from an electrically insulating x-ray shielding material, it is understood that only one or two of these components may be at least partially formed from an electrically insulating x-ray shielding material, depending on the shielding requirements of the x-ray tube into which the example high-voltage connector 300 is integrated.

Additional details regarding an example x-ray tube into which the high-voltage connector 300 can be integrated is the x-ray tube 100 disclosed in co-pending U.S. patent application Ser. No. 12/817,373, titled "X-RAY TUBE ROTATING ANODE," which was filed Jun. 17, 2010, which is incorporated herein by reference in its entirety.

4. Other Example Electrically Insulating X-Ray Shielding Devices

Although the example electrically insulating x-ray shielding devices disclosed in connection with FIGS. 1A-3C are configured as ceramic portions, gaskets, and potting material, it is understood that other electrically insulating x-ray shielding devices may be employed in other configurations and/or other locations in an x-ray tube. For example, various 0-rings, rubber expansion diaphragms, beam diaphragms, receptacle cups, stator shields, high-voltage sockets, feedthrus, and/or other structures that are proximate to an evacuated enclosure of an x-ray tube may be formed from electrically insulating x-ray shielding material(s), such as those materials disclosed herein. Thus, these electrically insulating x-ray shielding devices have a dual functionality of both electrically insulating and reducing or eliminating the need for supplemental x-ray shielding, thus reducing the cost and weight of any x-ray tube into which the devices are integrated. The discussion herein of electrically insulating x-ray shielding devices is therefore not limited to the embodiments disclosed in connection with FIGS. 1A-3C.

Further, while the electrically insulating x-ray shielding devices disclosed in connection with FIGS. 1A-3C generally serve to insulate and shield the cathode end of an x-ray tube, it is understood that electrically insulating x-ray shielding devices can similarly be employed to insulate and shield the anode end of an x-ray tube. The electrically insulating x-ray shielding devices disclosed herein can thus be employed in various regions of an x-ray tube.

The example embodiments disclosed herein may be embodied in other specific forms. The example embodiments disclosed herein are therefore to be considered in all respects only as illustrative and not restrictive.

What is claimed is:

1. A high-voltage gasket for an x-ray tube, the high-voltage gasket comprising an electrically insulating base material with electrically insulating x-ray shielding oxide or nitride particles dispersed therein, the dispersed electrically insulating x-ray shielding oxide or nitride particles having an atomic number from 57 to 74.

2. The high-voltage gasket as recited in claim 1, wherein the electrically insulating base material comprises a silicone-based rubber.

3. The high-voltage gasket as recited in claim 1, wherein the dispersed electrically insulating x-ray shielding oxide or nitride particles comprise cerium, erbium, ytterbium, or some combination thereof.

4. An x-ray tube comprising:

an evacuated enclosure;

a cathode and an anode at least partially positioned within the evacuated enclosure;

a high-voltage connector removably attached to the evacuated enclosure, the high-voltage connector configured to electrically couple a high-voltage electrical cable to the cathode, the high-voltage connector including a potting material configured to insulate electrical connections running through the high-voltage connector; and the high-voltage gasket as recited in claim 1 sealing the high-voltage connector to a ceramic portion of the evacuated enclosure, the high-voltage gasket also surrounding electrical connections running between the high-voltage connector and the cathode.

5. The x-ray tube as recited in claim 4, wherein the potting material has electrically insulating x-ray shielding particles dispersed therein, the electrically insulating x-ray shielding particles comprising electrically insulating x-ray shielding oxide or nitride particles having an atomic number from 57 to 74.

6. The x-ray tube as recited in claim 4, wherein the ceramic portion of the evacuated enclosure comprises an electrically insulating x-ray shielding oxide or nitride ceramic having an atomic number from 57 to 74.

7. The x-ray tube as recited in claim 4, wherein:

the potting material has a first dielectric constant;

the ceramic portion of the evacuated enclosure has a second dielectric constant; and the high-voltage gasket has a third dielectric constant between the first and second dielectric constants.

8. A high-voltage connector for an x-ray tube, the high-voltage connector comprising:

a shell configured to be removably attached to an evacuated enclosure of an x-ray tube;

an opening defined in the shell configured to receive a high-voltage electrical cable; and a potting material positioned within the shell, the potting material comprising an electrically insulating base material with electrically insulating x-ray shielding oxide or nitride particles dispersed therein.

9. The high-voltage connector as recited in claim 8, wherein the electrically insulating x-ray shielding particles comprise electrically insulating x-ray shielding oxide or nitride particles having an atomic number from 57 to 74.

10. The high-voltage connector as recited in claim 8, wherein the potting material comprises silicone-based rubber, an epoxy, or a plastic, or some combination thereof.

11. The high-voltage connector as recited in claim 8, wherein the potting material further has silicon glass particles or alumina ceramic particles dispersed therein.

12. An x-ray tube comprising:

an evacuated enclosure;

a cathode and an anode at least partially positioned within the evacuated enclosure;

the high-voltage connector as recited in claim 8 removably attached to a ceramic portion of the evacuated enclosure and electrically coupled to the cathode; and a high-voltage gasket sealing the high-voltage connector to the ceramic portion of the evacuated enclosure, the high-voltage gasket surrounding electrical connections running between the high-voltage connector and the cathode.

13. The x-ray tube as recited in claim 12, wherein the ceramic portion of the evacuated enclosure comprises an electrically insulating x-ray shielding oxide or nitride ceramic having an atomic number from 57 to 74.

14. The x-ray tube as recited in claim 12, wherein the high-voltage gasket comprises an electrically insulating base material with electrically insulating x-ray shielding oxide or nitride particles dispersed therein, the dispersed electrically insulating x-ray shielding oxide or nitride particles having an atomic number from 57 to 74.

15. The x-ray tube as recited in claim 12, wherein:

the potting material has a first dielectric constant;

the ceramic portion of the evacuated enclosure has a second dielectric constant; and the high-voltage gasket has a third dielectric constant between the first and second dielectric constants.

16. An x-ray tube comprising:

an evacuated enclosure including a ceramic portion comprising an electrically insulating x-ray shielding oxide or nitride ceramic having an atomic number from 57 to 74;

an anode at least partially positioned within the evacuated enclosure; and a cathode at least partially positioned within the evacuated enclosure, the cathode electrically coupled to electrical connections that run through the ceramic portion of the x-ray tube.

17. An x-ray tube comprising:

an evacuated enclosure;

a cathode and an anode at least partially positioned within the evacuated enclosure; and an electrically insulating x-ray shielding device proximate to the evacuated enclosure, the electrically insulating x-ray shielding device comprising an oxide or nitride material having an atomic number from 57 to 74.

18. The x-ray tube as recited in claim 17, wherein the electrically insulating x-ray shielding device comprises an oxide or nitride ceramic.

19. The x-ray tube as recited in claim 17, wherein the electrically insulating x-ray shielding device comprises an electrically insulating base material with electrically insulating x-ray shielding oxide or nitride particles dispersed therein.

20. The x-ray tube as recited in claim 19, wherein the electrically insulating x-ray shielding device is configured as an O-ring, a rubber expansion diaphragm, a beam diaphragm, a receptacle cup, a stator shield, a high-voltage socket, or a feedthru.

* * * * *